US009495810B2

(12) United States Patent
Krishnamurthy et al.

(10) Patent No.: US 9,495,810 B2
(45) Date of Patent: Nov. 15, 2016

(54) DETERMINATION OF WHETHER A DRIVER PARKS THEIR VEHICLE IN AN ENCLOSED STRUCTURE

(71) Applicant: Nissan North America, Inc., Franklin, TN (US)

(72) Inventors: Vikram Krishnamurthy, Smyrna, GA (US); Daisuke Saito, Sunnyvale, CA (US)

(73) Assignee: Nissan North America, Inc., Franklin, TN (US)

( * ) Notice: Subject to any disclaimer, the term of this patent is extended or adjusted under 35 U.S.C. 154(b) by 0 days.

(21) Appl. No.: 14/165,686

(22) Filed: Jan. 28, 2014

(65) Prior Publication Data

US 2015/0213654 A1 Jul. 30, 2015

(51) Int. Cl.

*G07B 15/02* (2011.01)
*G07C 5/08* (2006.01)
*G07C 5/00* (2006.01)

(52) U.S. Cl.

CPC ..... *G07C 5/00* (2013.01); *G07B 15/02* (2013.01); *G07C 5/008* (2013.01)

(58) Field of Classification Search

USPC ..... 701/468
See application file for complete search history.

(56) References Cited

U.S. PATENT DOCUMENTS 6,025,774 A * 2/2000 Forbes ..... B60R 25/00 235/384
7,516,010 B1 * 4/2009 Kaplan ..... G01C 21/30 340/932.2
7,538,690 B1 * 5/2009 Kaplan ..... G01C 21/20 340/932.2
8,447,863 B1 * 5/2013 Francis, Jr. ..... G06F 17/30542 707/724
8,495,143 B2 * 7/2013 Zhou ..... G06Q 10/10 705/14.66
8,521,419 B2 8/2013 Korn et al.
8,881,028 B2 * 11/2014 Klinger ..... G06Q 10/00 715/703
9,141,582 B1 * 9/2015 Brinkmann ..... G06F 17/00
9,183,572 B2 * 11/2015 Brubaker ..... G06Q 30/02
2006/0206246 A1 * 9/2006 Walker ..... G06Q 10/00 701/16
2009/0055090 A1 2/2009 Cowley et al.
2009/0299857 A1 * 12/2009 Brubaker ..... G06Q 30/02 705/14.66
2010/0161638 A1 * 6/2010 Macrae ..... G06F 17/30864 707/759
2010/0274432 A1 * 10/2010 Dlugoss ..... G07C 5/085 701/31.4
2011/0093949 A1 * 4/2011 Macrae ..... G06F 17/30864 726/19
2012/0069131 A1 * 3/2012 Abelow ..... G06Q 10/067 348/14.01
2012/0323643 A1 * 12/2012 Volz ..... G07B 15/02 705/13
2014/0232570 A1 * 8/2014 Skinder ..... G01C 21/165 340/989
2015/0087263 A1 * 3/2015 Branscomb ..... H04W 4/021 455/410
2016/0004999 A1 * 1/2016 Chivetta, III ..... G06Q 10/103 705/301
2016/0005124 A1 * 1/2016 Chivetta, III ..... G06Q 40/06 705/36 R
2016/0005125 A1 * 1/2016 Chivetta, III ..... G06Q 40/06 705/36 R

* cited by examiner

*Primary Examiner* — Jean-Paul Cass
(74) *Attorney, Agent, or Firm* — Young Basile Hanlon & MacFarlane, P.C.

(57) ABSTRACT

In a method for identifying the parking status of a vehicle, navigation data for a vehicle is recorded that includes at least some GPS navigation data originating from communication with GPS satellites. The vehicle is identified as being parked in an enclosed structure for a parking event if the navigation data does not include GPS navigation data associated with the parking event.

10 Claims, 2 Drawing Sheets

30

| VEHICLE DATA 40 | | | | |
|---|---|---|---|---|
| TIME | NAVIGATION DATA | | GPS NAVIGATION DATA TAG | VEHICLE CONDITION DATA |
| | LATITUDE | LONGITUDE | | |
| | | | | |
| | | | | |
| | | | | |
| ... | ... | ... | ... | ... |

DETERMINATION OF WHETHER A DRIVER PARKS THEIR VEHICLE IN AN ENCLOSED STRUCTURE

TECHNICAL FIELD

The embodiments disclosed herein generally relate to the evaluation of recorded vehicle data.

BACKGROUND

Vehicle manufacturers and vehicle dealers may desire information concerning how well their vehicles are maintained in the field. For example, vehicle manufacturers and vehicle dealers may be interested in knowing whether, and to what extent, drivers park their vehicles in enclosed structures, such as garages. This information may give a vehicle manufacturer insight into the resale value of its vehicles. Similarly, this information may be used by a vehicle dealer to estimate the residual value of a leased vehicle.

SUMMARY

Disclosed herein are embodiments of systems in which recorded vehicle data is evaluated to determine whether a vehicle is and/or has been parked in an enclosed structure. In one aspect, a method for identifying the parking status of a vehicle comprises recording navigation data for a vehicle, wherein the navigation data includes at least some GPS navigation data originating from communication with GPS satellites, and identifying the vehicle as being parked in an enclosed structure for a parking event if the navigation data does not include GPS navigation data associated with the parking event.

In another aspect, an apparatus for identifying the parking status of a vehicle comprises at least one processor configured to execute instructions stored in a memory to record navigation data for a vehicle, wherein the navigation data includes at least some GPS navigation data originating from communication with GPS satellites, and identify the vehicle as being parked in an enclosed structure for a parking event if the navigation data does not include GPS navigation data associated with the parking event.

In yet another aspect, a method for identifying the parking status of a vehicle comprises recording data for a vehicle, wherein the data includes navigation data and vehicle condition data, associating at least some of the navigation data with a parking event for the vehicle based on the vehicle condition data, and identifying the vehicle as being parked in an enclosed structure for the parking event if the navigation data associated with the parking event did not originate from communication with GPS satellites.

These and other aspects will be described in additional detail below.

BRIEF DESCRIPTION OF THE DRAWINGS

The various features, advantages and other uses of the present apparatus and methods will become more apparent by referring to the following detailed description and drawings in which.

DETAILED DESCRIPTION

Figures 1, 2:
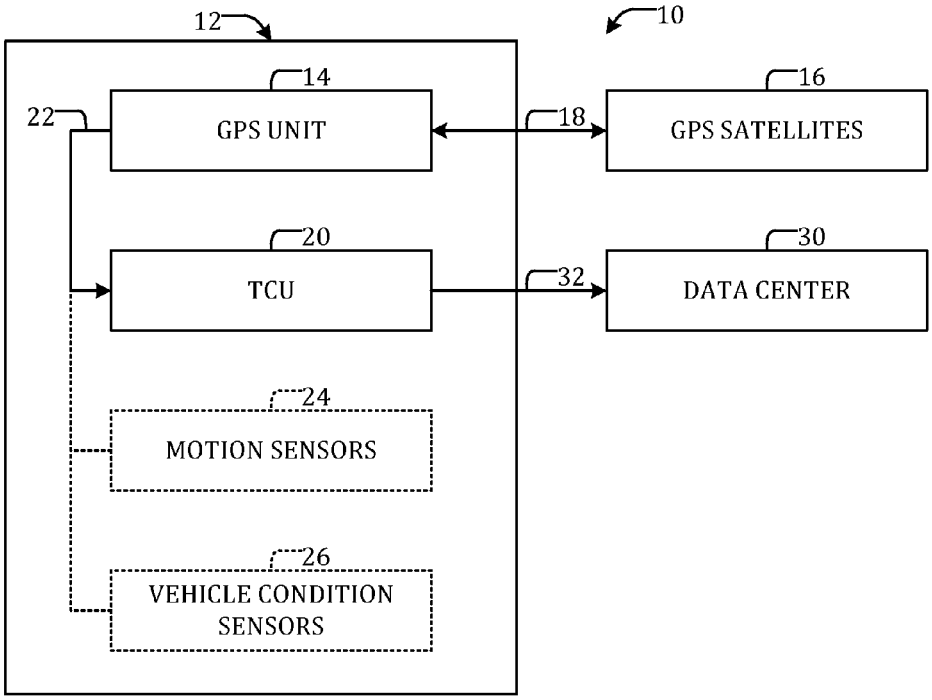
FIG. 1 is a schematic block diagram of an example of a system for generating vehicle data and recording the vehicle data for evaluation, showing a data center and a vehicle with a telematics control unit (TCU) for communicating vehicle data to the data center.
FIG. 2 represents an example of a data structure for recording the vehicle data.

FIG. 1 is a schematic representation of an example of a system 10 for use in collecting and recording vehicle data 40 from a vehicle 12 for remote evaluation. As explained below with reference to FIG. 2, in the system 10, the vehicle data 40 will include but is not limited to navigation data for the vehicle 12.

In the example system 10, the vehicle 12 is generally configured to support the generation of navigation data for the vehicle 12. As shown, the vehicle 12 is equipped with a global positioning system (GPS) unit 14. The GPS unit 14 is communicatively coupled to a plurality of GPS satellites 16 over a communications channel 18. The communication channel 18 may be a wireless channel, for example, using a standard or proprietary protocol. The GPS satellites 16 may generally be configured to communicate signals to the GPS unit 14 that permit the position of the GPS unit 14, and by extension the vehicle 12, to be determined. In a non-limiting example, the position of the vehicle 12 may be associated with a coordinate system, such as a geographic coordinate system, for instance, that specifies position with reference to a latitude and longitude.

The GPS unit 14 is further communicatively coupled to a telematics control unit (TCU) 20 for the vehicle 12 over a communications channel 22. The communication channel 22 may be a wired or wireless channel configured to allow for sharing of information, data and/or computing resources between the GPS unit 14 and the TCU 20. The GPS unit 14, the TCU 20 and optionally, other devices, may be configured with respective hardware and software so that collectively signals may be received from the GPS satellites 16, multiple positions of the vehicle 12 over a period of time may be determined, and corresponding GPS navigation data for the vehicle 12 (i.e., navigation data originating from communication between the GPS unit 14 and the GPS satellites 16) may be stored in memory.

The GPS unit 14 and the TCU 20 may each be one or multiple computers including a random access memory (RAM), a read-only memory (ROM) and a central processing unit (CPU) in addition to various input and output connections. Generally, the control functions of the vehicle 12 described herein can be implemented by one or more software programs stored in internal or external memory and are performed by execution by the respective CPUs of the GPS unit 14 and the TCU 20. However, some or all of the functions could also be implemented by hardware components. Although the GPS unit 14 and the TCU 20 are shown as separate units and described as performing respective operations, it will be understood that the operational aspects of the GPS unit 14 and the TCU 20 may be distributed differently than as specifically described. In one alternative, for example, the operational aspects of the GPS unit 14 and the TCU 20 could be embodied in a single unit.

The generation of standalone GPS navigation data for the vehicle 12 generally relies on communication between the GPS unit 14 and the GPS satellites 16 over the communications channel 18. Therefore, it will be understood that GPS navigation data will not be generated for the vehicle 12 for periods where the communications channel 18 between the GPS unit 14 and the GPS satellites 16 is broken. The GPS navigation data for the vehicle 12 originating from communication between the GPS unit 14 and the GPS satellites 16 may be augmented with other navigation data. For example, as shown in FIG. 1, the vehicle 12 may optionally be equipped with one or more motion sensors 24 for supporting the generation of supplemental navigation data for the vehicle 12. The motion sensors 24 could be or include, for instance, an accelerometer or a gyroscope. According to this example, the TCU 20 could be configured to implement a so-called dead reckoning algorithm using GPS navigation data and input from the motion sensors 24 to generate supplemental navigation data for the vehicle 12. In other non-limiting examples of the vehicle 12, the TCU 20 could be configured, for instance, to implement a map-matching technique and/or assisted GPS to generate supplemental navigation data for the vehicle 12 using GPS navigation data.

The vehicle 12 may be configured to support the generation of other types of data for the vehicle 12 in addition to navigation data. For example, as shown, the vehicle 12 may optionally be equipped with vehicle condition sensors 26 for sensing or otherwise indicating any variety of conditions of the vehicle 12. The corresponding vehicle condition data can concern a variety of operational aspects of the vehicle 12, such as whether the vehicle 12 is powered on or off, for instance. The vehicle condition data sensed or otherwise indicated by the vehicle condition sensors 26 can be communicated to the TCU 20 as generally shown.

In the example system 10, the navigation data and any available vehicle condition data for the vehicle 12 may be correlated to a time element and transmitted by the TCU 20 to a remote data center 30 over a wireless communications channel 32 for evaluation, for example, by a vehicle manufacturer or dealer.

As represented in FIG. 2, the transmitted data can be stored at the data center 30 as vehicle data 40. In general, the vehicle data 40 is indicative, among other things, of the position of the vehicle 12 over a period of time. The vehicle data 40 may include raw values of navigation data that correspond to the position of the vehicle 12, which in an exemplary geographic coordinate system is specified in terms of latitude and longitude. The vehicle data 40 additionally includes a time at which the vehicle 12 was located at each position.

In the system 10, any standalone GPS navigation data originating from communication between the GPS unit 14 and the GPS satellites 16 is tagged or otherwise indicated as GPS navigation data. It will be understood that this indication may be implicit in examples of the system 10 where the only available navigation data is GPS navigation data. The vehicle data 40 may also indicate the accuracy, or strength, of the GPS navigation data. The strength of the GPS navigation data may be reflected, for example, in the number of GPS satellites 16 that contributed to the generation of the GPS navigation data. In a typical but non-limiting example of the system 10, full strength GPS navigation data may require communication with four GPS satellites 16, while communication with three GPS satellites 16 results in medium strength GPS navigation data, and communication with two or one GPS satellites 16 results in low strength GPS navigation data. Supplemental navigation data, if any, may lack a tag or other indication as being GPS navigation data and/or may be tagged or otherwise indicated as not being GPS navigation data. As explained above, the vehicle data 40 may further include vehicle condition data concerning the operation of the vehicle 12.

According to the illustrated and non-limiting example of the system 10, the GPS unit 14, the TCU 20, the optional motion sensors 24 and any other equipment for supporting the generation of navigation data for the vehicle 12 may be embedded in the vehicle 12. Similarly, the TCU 20 and any other equipment for supporting the transmission of the navigation data for the vehicle 12, and the vehicle condition data for the vehicle 12, if any, for remote recordation as vehicle data 40 at the data center 30 may also be embedded in the vehicle 12. In alternative examples of the system 10, other equipment may be implemented to generate navigation data for the vehicle 12 and/or transmit the navigation data and the vehicle condition data for the vehicle 12, either in place of or in addition to some or all of the equipment illustrated and described above as being embedded in the vehicle 12. For instance, in a non-limiting alternative example of the system 10, a mobile device such as a cell phone may be implemented to generate some or all of the navigation data for the vehicle 12, and/or to transmit some or all of the navigation data and the vehicle condition data for the vehicle 12. In another non-limiting alternative example of the system 10, the generated navigation data and the vehicle condition data for the vehicle 12 can be communicated to the data center 30 in part with a portable storage medium such as an SD card or a USB drive.

Exemplary operations for the system 10 are explained with reference to FIG. 3. According to one non-limiting example of the system 10, the evaluation of the vehicle data 40 is performed at the data center 30 under the control, for example, of a vehicle manufacturer or dealer. The data center 30 may be one or multiple computers including a random access memory (RAM), a read-only memory (ROM) and a central processing unit (CPU) in addition to various input and output connections. Generally, the control functions of the data center 30 described herein can be implemented by one or more software programs stored in internal or external memory and are performed by execution by the CPU of the data center 30. However, some or all of the functions could also be implemented by hardware components. Although the evaluation of the vehicle data 40 is described with reference to the data center 30, in alternative examples of the system 10, some or all of the evaluation of the vehicle data 40 may be performed or otherwise supported using equipment embedded in the vehicle 12, such as the TCU 20, or using other equipment, such as a mobile device, with the results being transmitted to the data center 30 for recordation and/or further evaluation.

Figure 3:
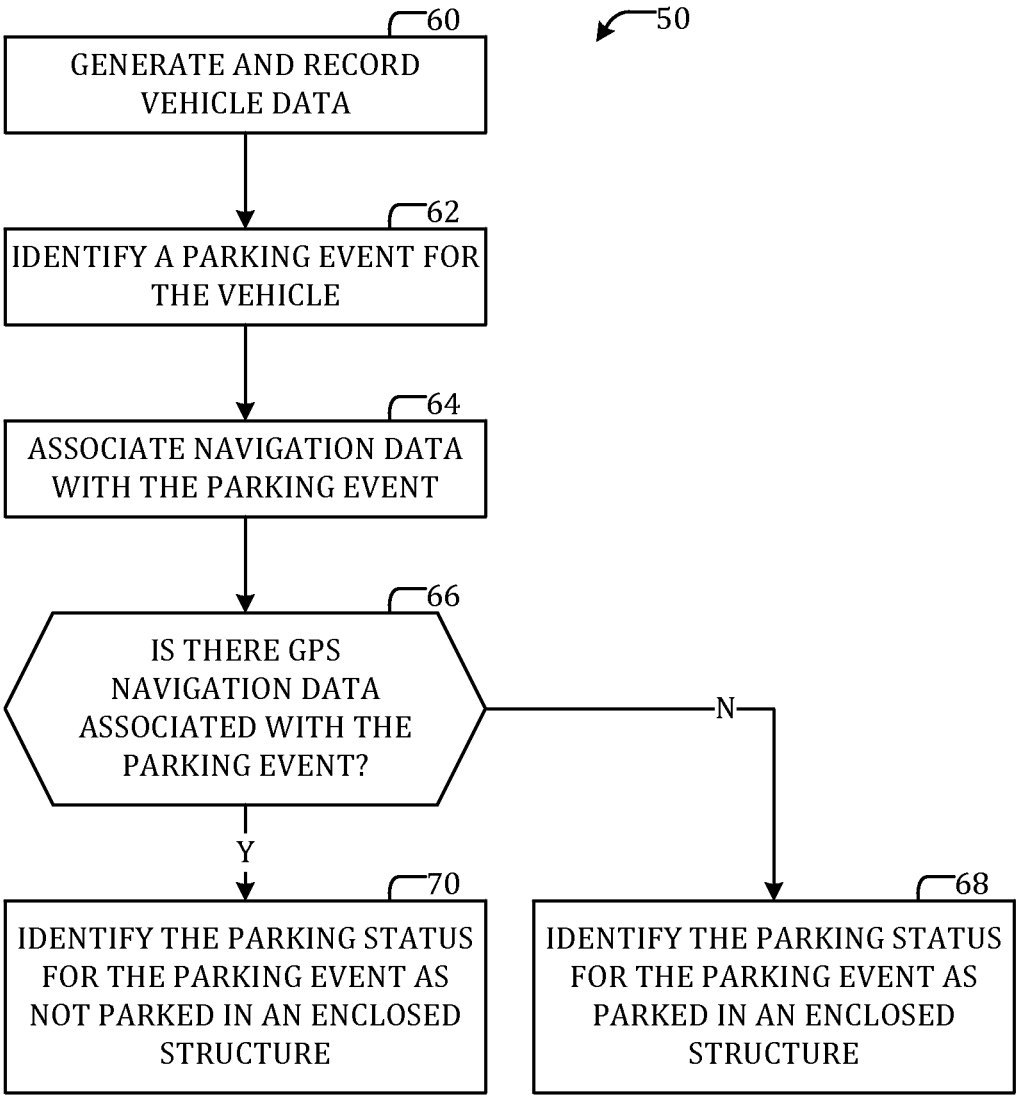
FIG. 3 is a flow diagram depicting operations for evaluating the recorded vehicle data to identify the parking status of a vehicle.

FIG. 3 depicts the operations of a process 50 for gathering the vehicle data 40 and evaluating the vehicle data 40 to determine the parking status of the vehicle 12. In particular, as explained below, the process 50 can be implemented to determine whether the vehicle 12 is and/or has been parked in an enclosed structure, such as a garage.

In operation 60, the vehicle data 40 is generated and recorded at the data center 30. As generally explained above, the vehicle data 40 will include navigation data for the vehicle 12 and may optionally include contemporaneous vehicle condition data for the vehicle 12.

In operation 62, a parking event for the vehicle 12 is identified. The parking event may, for example, be identified based on the navigation data for the vehicle 12. The navigation data for the vehicle 12 is generally indicative of the position of the vehicle 12 over a period of time, as explained above, and may be analyzed to identify one or more routes traveled by the vehicle 12. According to this example, the terminus of each of the identified routes traveled by the vehicle 12 can be recognized from the navigation data and correlated to a parking event for the vehicle 12.

A terminus of a route traveled by the vehicle 12 could alternatively or additionally be recognized based on the vehicle condition data for the vehicle 12. The vehicle condition data may generally be indicative of the operational aspects of the vehicle 12 including, for example, instances of the vehicle 12 being powered on or off. According to this example, a terminus of a route traveled by the vehicle 12 could be recognized from an instance of the vehicle 12 being powered off and correlated to a parking event for the vehicle 12 occurring subsequent to the vehicle 12 being powered off, or, a terminus of a route traveled by the vehicle 12 could be recognized from an instance of the vehicle 12 being powered on and correlated to a parking event for the vehicle 12 occurring prior to the vehicle 12 being powered on. Similarly, the elapsed time between an instance of the vehicle 12 being powered off and an instance of the vehicle 12 being powered on could be correlated to a parking event for the vehicle 12.

Any variety of filters may be placed on the correlation of a terminus of a route traveled by the vehicle 12 to a parking event for the vehicle 12. The filters may be designed, for instance, so that the identified parking events will be of particular significance to a manufacturer or dealer of the vehicle 12 in the context of a determination of the extent to which the vehicle 12 is parked in enclosed structures.

In one example, a recognized terminus of a route traveled by the vehicle 12 could be correlated to a parking event for the vehicle 12 only if the vehicle 12 was located at the terminus for a predetermined period of time and/or within a specified time window. In another example, a recognized terminus of a route traveled by the vehicle 12 could be correlated to a parking event for the vehicle 12 only if the terminus corresponds in location to a home address, work address or other address for a driver of the vehicle 12. An address of interest may be identified on the basis of public records and/or private records associated with a sale or lease of the vehicle 12 to the driver. An address of interest could also be identified from the configuration or the settings of a navigation system for the vehicle 12, including for instance favorite or bookmarked locations. Alternatively, an address could be identified by analyzing patterns within the navigation data. A home address, for instance, could be identified at a location that the vehicle 12 routinely leaves from and arrives to. For a typical driver, this location could be for example a location that the vehicle 12 routinely leaves from in the morning and arrives to at night on weekdays. Although an identification of a home address is explained in accordance with one example, it will be understood that other addresses of interest could be identified on the basis of the navigation data for the vehicle 12.

It will be understood that the foregoing filters on the correlation of a terminus of a route traveled by the vehicle 12 to a parking event for the vehicle 12 are provided as non-limiting examples that may be placed individually or in any combination with one another or with any other filters. In one non-limiting example, a recognized terminus of a route traveled by the vehicle 12 could be correlated to a parking event for the vehicle 12 only if the terminus corresponds in location to the home address for a driver of the vehicle 12 and the vehicle 12 was located at the home address for a specified stay. The specified stay, for instance, could correspond to an overnight stay.

In operation 64, if necessary, an attempt is made to associate at least some of the navigation data from the vehicle data 40 with the parking event for the vehicle 12 identified in operation 62. An association between the parking event for the vehicle 12 and at least some of the navigation data for the vehicle 12 may already be implicit if, for instance, the parking event was identified in operation 64 based in whole or in part on the navigation data. However, an attempt at an association between the parking event for the vehicle 12 and at least some of the navigation data for the vehicle 12 may have to be made, for instance, if the parking event was identified only based on the vehicle condition data for the vehicle 12.

In operation 66, it is determined whether there is any GPS navigation data from the vehicle data 40 that is or has been associated the parking event for the vehicle 12.

In an example of the system 10 where the equipment used to support the generation of the navigation data included in the vehicle data 40 (e.g., the GPS unit 14, the TCU 20 and the motion sensors 24) supports the generation of both GPS navigation data and supplemental navigation data not originating from communication between the GPS unit 14 and the GPS satellites 16, any available GPS navigation data in the vehicle data 40 will be tagged or otherwise indicated as GPS navigation data. According to this example of the system 10, the determination in operation 66 will depend on whether the navigation data from the vehicle data 40 that is or has been associated the parking event for the vehicle 12, if any, is GPS navigation data.

In an example of the system 10 where the equipment used to support the generation of the navigation data included in the vehicle data 40 (e.g., the GPS unit 14 and the TCU 20) only supports the generation of GPS navigation data, all of the generated navigation data will be GPS navigation data. According to this example of the system 10, since it can generally be assumed that any available navigation data in the vehicle data 40 is GPS navigation data, the determination in operation 66 will depend simply on whether there is any navigation data from the vehicle data 40 that is or has been associated the parking event for the vehicle 12.

A negative determination in operation 66 signifies the absence of GPS navigation data associated with the identified parking event for the vehicle 12. Since GPS navigation data can generally be generated during periods of communication between the GPS unit 14 and the GPS satellites 16, it can be assumed from the absence of GPS navigation data associated with the identified parking event for the vehicle 12 that the communications channel 18 between the GPS unit 14 and the GPS satellites 16 was broken for the parking event.

A typical circumstance that breaks the communications channel 18 between the GPS unit 14 and the GPS satellites 16 is where the vehicle 12 is located in a substantially enclosed structure, such as a garage. Based on the assumption that the communications channel 18 between the GPS unit 14 and the GPS satellites 16 was broken for the identified parking event for the vehicle 12, in operation 68, the vehicle 12 can be identified as being parked in an enclosed structure for the parking event.

In contrast, a positive determination in operation 66 signifies the presence of GPS navigation data associated with the identified parking event for the vehicle 12, from which it can be assumed that there was an open line of communication between the GPS unit 14 and the GPS satellites 16 over the communications channel 18 for the parking event. Based on the assumption that there was an open line of communication between the GPS unit 14 and the GPS satellites 16 over the communications channel 18 for the parking event for the vehicle 12, in operation 70, the vehicle 12 can be identified as not being parked in an enclosed structure for the parking event.

If the vehicle data 40 indicates the strength of the GPS navigation data, a further determination can be made under operation 66 of the type of structure, if any, other than an enclosed structure, in which the vehicle 12 is located. If, for example, the GPS navigation data is full strength GPS navigation data generated during a period of communication with four or more GPS satellites 16, then the vehicle 12 can be identified as being parked in open air parking for the parking event. If the GPS navigation data is medium strength GPS navigation data generated during a period of communication with, for instance, three GPS satellites 16, then the vehicle 12 can be identified as being parked in open air parking but behind, for example, a building or other structure for the parking event. If the GPS navigation data is low strength GPS navigation data generated during a period of communication with, for instance, two or one GPS satellites 16, then the vehicle 12 can be identified as being parked in semi-open air parking, such as a under a canopy or other structure with open walls, for the parking event.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for identifying the parking status of a vehicle, comprising:

a GPS unit configured to generate, via communication with GPS satellites, GPS navigation data for a vehicle;

at least one vehicle condition sensor on the vehicle configured to generate non-GPS navigation data for the vehicle; and at least one processor, the at least one processor configured to execute instructions stored in a memory to:

record navigation data for the vehicle, the navigation data including at least the GPS navigation data and the non-GPS navigation data;

identify, based on the navigation data, a parking event for the vehicle;

determine if the parking event is an open parking event where the vehicle is not covered or a covered parking event where the vehicle is in an enclosed structure by:

associating at least some of the navigation data with the parking event;

identifying whether the navigation data associated with the parking event is GPS navigation data;

identifying the parking event as the covered parking event when the navigation data associated with the parking event is not GPS navigation data; and identifying the parking event as the open parking event when the navigation data associated with the parking event is GPS navigation data; and track a duration of each covered parking event and a duration of each open parking event throughout a lease or ownership period of time; and transmit the duration of covered parking events and duration of open parking events in the lease or ownership period of time to a third party as a basis for reassessing a value of the vehicle based in part on the total duration of the covered parking events and open parking events during the lease or ownership period of time.

2. The apparatus of claim 1, wherein the at least one processor is further configured to execute instructions stored in the memory to:

identify a strength of the GPS navigation data associated with the parking event; and determine a type of structure other than an enclosed structure based on the strength of the GPS navigation data associated with the parking event.

3. The apparatus of claim 1, wherein the at least one processor is further configured to execute instructions stored in the memory to:

identify, from the navigation data, a terminus of a route traveled by the vehicle; and identify whether the terminus corresponds in location to an address of interest; and correlate the terminus to the parking event when the terminus corresponds in location to the address of interest.

4. The apparatus of claim 3, wherein the at least one processor is further configured to execute instructions stored in the memory to:

identify the address of interest based on navigation patterns indicated by the navigation data.

5. The apparatus of claim 1, wherein the non-GPS navigation data is data indicating the vehicle is powered off, and the at least one processor is further configured to execute instructions stored in the memory to:

identify last recorded non-GPS navigation data upon the vehicle being powered off; and associate the last recoded non-GPS navigation data with the parking event.

6. The apparatus of claim 1, wherein the non-GPS navigation data is data indicating the vehicle is powered on, and the at least one processor is further configured to execute instructions stored in the memory to:

identify first recorded non-GPS navigation data upon the vehicle being powered on; and associate the first recorded non-GPS navigation data with the parking event.

7. A method for identifying the parking status of a vehicle, comprising:

generating, with a GPS unit in communication with GPS satellites, GPS navigation data for a vehicle;

generating, with vehicle motion sensors, supplemental navigation data for the vehicle;

recording navigation data for the vehicle, the data including the GPS navigation data and the supplemental navigation data;

identifying, based at least in part on the vehicle condition data, a parking event for the vehicle corresponding to a covered parking event where the vehicle is in an enclosed structure or an open parking event where the vehicle is not covered, wherein identifying the parking event comprises:

associating at least some of the navigation data with the parking event;

identifying whether the navigation data associated with the parking event is GPS navigation data; and identifying the parking event as the covered parking event when the navigation data associated with the parking event is not GPS navigation data; and identifying the parking event as the opened parking event when the navigation data associated with the parking event is GPS navigation data;

tracking a duration of each covered parking event and a duration of each open parking event throughout a lease or ownership period of time; and transmitting the duration of covered parking events and open parking events to a third party, the third party assessing a behavior of a driver of the vehicle during the lease or ownership period of time based in part on the total duration of covered parking events and open parking events during the lease or ownership period of time.

8. The method of claim 7, further comprising:

generating, with vehicle condition sensors, vehicle condition data for the vehicle contemporaneous to the navigation data, wherein the vehicle condition data indicates at least whether the vehicle is powered off or on;

recording the vehicle condition data; and associating at least one of last recorded navigation data upon the vehicle being powered off at an address of interest or first recorded navigation data upon the vehicle being powered on at the address of interest with the parking event.

9. The apparatus of claim 3, wherein the at least one processor is further configured to execute instructions stored in the memory to:

identify a home address for a user of the vehicle; and designate the home address as the address of interest.

10. The apparatus of claim 3, wherein the at least one processor is further configured to execute instructions stored in the memory to:

identify the address of interest based on records associated with a sale or lease of the vehicle.

* * * * *